United States Patent [19]

Bruström

[11] Patent Number: 4,826,358

[45] Date of Patent: May 2, 1989

[54] DEVICE FOR ANCHORING IN AND/OR REINFORCING HARD MATERIALS

[76] Inventor: Bertil Bruström, Boarp 790, 26200 Ängelholm, Sweden

[21] Appl. No.: 30,858

[22] PCT Filed: Jun. 6, 1986

[86] PCT No.: PCT/SE86/00268

§ 371 Date: Feb. 9, 1987

§ 102(e) Date: Feb. 9, 1987

[87] PCT Pub. No.: WO86/07410

PCT Pub. Date: Dec. 18, 1986

[30] Foreign Application Priority Data

Jun. 7, 1985 [SE] Sweden ..... 8502814

[51] Int. Cl.[4] ..... E21D 21/00

[52] U.S. Cl. ..... 405/259; 411/33; 411/36

[58] Field of Search ..... 405/258, 259, 260, 261, 405/262; 411/32, 33, 34, 36

[56] References Cited

U.S. PATENT DOCUMENTS

| | | | |
|---|---|---|---|
| 1,293,844 | 2/1919 | Malaby | 411/36 |
| 2,696,137 | 12/1954 | Thomas et al. | 405/259 X |
| 4,147,458 | 4/1979 | Elders | 405/259 |

FOREIGN PATENT DOCUMENTS

| | | | |
|---|---|---|---|
| 1525127 | 4/1968 | France | 411/36 |

*Primary Examiner*—David H. Corbin
*Attorney, Agent, or Firm*—Browdy & Neimark

[57] ABSTRACT

A device for anchoring in and/or reinforcing hard materials, such as stone, concrete and the like, is described. The device consists of a continuous body, made in one piece, designed for insertion axially into a mounting hole in said materials and which has, transverse to its axis, expansible gripping surfaces or points arranged so as to, when expanded, bear against and engage the sides of the hole for anchoring the device into the hole. In order to achieve the said expansion of the gripping surfaces or points, the shell is provided with, firstly, one or more axial rows (1,2) of pressure absorbing braces (3) between the expansible gripping surfaces or points, which braces (3) are, at least upon insertion of the device in the hole, inclined to the axial direction of the device with their first ends (6) axially displaced in relation to their second ends (7) in a direction towards the insertion end (5) of the device. And secondly, a connecting member (4) linking the braces (3), to which the first ends (6) of the braces are flexibly joined and upon which an axial pull out load is applied in order to produce compressive forces in the braces (3) and their increased inclination to the axis of the device, thereby producing an expansion force upon the gripping surfaces or points in a direction towards the sides of the holes.

10 Claims, 5 Drawing Sheets

DEVICE FOR ANCHORING IN AND/OR REINFORCING HARD MATERIALS

BACKGROUND OF THE INVENTION

1. Field of the Invention

The present invention relates to a device for anchoring in and/or reinforcing hard materials, such as stone, concrete and the like. The device consists of a continuous body, made in one piece designed for insertion axially into a hole in said materials and which has, transverse to its axis, expansible gripping surfaces or points arranged so as to, when expanded, bear against and engage the sides of the hole for anchoring the device into the hole.

2. The Prior Art

The mechanical anchoring of objects into very hard building materials such as stone, brick and concrete, usually requires a prebored hole of a diameter suitable for the gripping surfaces. An exception is hard steel studs or nails, which may only be driven by very great force from, for example, an explosive-operated stud gun.

Hole-mounted anchors, however, of several different kinds are to be found. A common type are plugs of various constructions, the gripping surfaces or points of which are designed to be forced against the hole walls by the driving of a conical screw. Also, there are various kinds of expansion bolts where one or more sleeves or segments are forced to expand into conical surfaces by a turned bolt. Other constructions can be likened to split sleeves or spikes which are axially displaceable from each other, while others can again be cylindrical, sprung tube segments with special configurations. Furthermore, there are angled loops or wires with a hooking grip against the hole walls.

Another construction, intended specially for reinforcement purposes, is in the form of a deformable tube so constructed that it can be made to expand by a high internal hydraulic pressure.

None of the known anchors or reinforcing members fulfill the demands which could reasonably be made upon a theoretically objection-free and optimum anchoring or reinforcing device for hard materials. Among reasonable demands and requirements, the following properties ought to be specified:

The device should, with the cheapest possible manufacture in mind, consist of a single component without the need for intermediate assembly or the like. It should require a minimum of resources and be simple to mass-produce, thus creating the conditions for a low purchase price for the end user.

The device should also be easy to install and remove on site and should not require any major professional expertise.

The construction principles should be such that the device becomes self-locking, which means that the gripping force should increase upon an increased pulling force.

Through construction and choice of materials, the device should have good static performance and high tolerance to vibrating or pulsating loads.

To function most effectively the distribution of pressure against the hole walls should be spread over a large area and be uniform along the entire length of the hole.

Normal cavities in the material, for example in hollow blocks, should not result in an absence of gripping force.

To reduce the cost of and to limit stock and assortment, the device should be versatile in its uses and universal in its function. It should also allow the use of extensions and accessories of various kinds.

With regard to safety and reliability, the device should be fire and temperature proof and also resistant to corrosion and ageing.

Finally, it is in many cases advantageous if the device used can to some degree compensate for small errors in centering which occur during drilling, especially when hammer-drilling in heavy stone material.

SUMMARY OF THE INVENTION

The present invention aims to fulfill these stated requirements in their entirety. This aim has been achieved through the basic concept of the invention. This allows, within a single component or body, as stated in the introduction, which is easy to mass-produce with known techniques, the provision of one or more rows of rotatable or bendable braces, which serve as expanding and load absorbing elements. These absorb and distribute the tensile and compressive forces which can act upon other parts of the body and which can be numerous and connected and directed at various sectors of the circumference of the shell.

The device in accordance with the invention is made preferably from a sheet metal, generally in strip form. Through cutting, stamping and bending operations in tools set up in an eccentric press or similar, it is easy to produce many variants of the invention, of which some examples will be described in the following text. Other means of manufacture can be die casting or sintering of metal or plastic.

Special characteristics of the device in accordance with the invention are given in patent claim 1, and the characteristics of those forms presented are taken up in the non-independent patent claims.

A common feature of all the devices in accordance with the invention is that the device's body, which is made in one piece of, e.g. sheet steel, has firstly one or more axial rows of pressure absorbing braces and, secondly, a connecting member joining the ends of the braces which are turned towards the insertion end of the device. The inclined braces in accordance with the invention have thus the same function as, for example, a screw in the fastening of a plastic plug of the traditional type, i.e. an expanding pressure effect upon the expansible gripping surfaces or points of the body. Since the inner ends of the braces are joined to each other by a connecting member, the outer end of which, or any accessory attached thereto, should extend to outside the hole once the device has been inserted, then the application of axial extraction forces upon the connecting member will transfer axial extraction forces to each of these brace ends, whereby the braces become more transverse to the axial direction of the device in order to achieve the desired expansion and a self-locking effect. The relative orientation of the rows of braces and the connecting member can be varied in many different ways whilst retaining the expanding and self-locking functions in accordance with the invention.

The other ends of the braces, which are not joined with the connecting member, can in some designs be joined together by gripping bars, which extend along the said rows of braces. Also in this case, the device displays its characteristics in accordance with the invention, namely that an increased rotation or inclination of the braces can achieve an expansion of the gripping surfaces or points, which in this case partly comprise the gripping bars.

BRIEF DESCRIPTION OF THE DRAWINGS

The invention will now be described more closely in the following text covering several different designs, and with reference to the accompanying drawings, in which.

BRIEF DESCRIPTION OF THE PREFERRED EMBODIMENTS

Figure 1B:
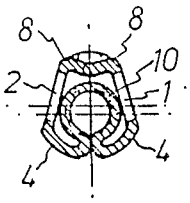
FIGS. 1A–1D show a first design of the invention for anchoring purposes.
Figure 1A:
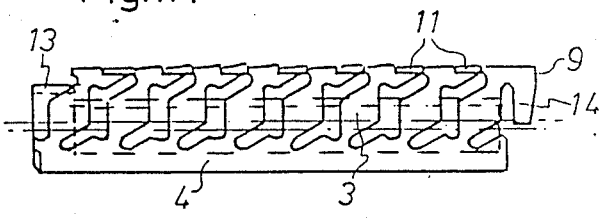
Figure 1C:
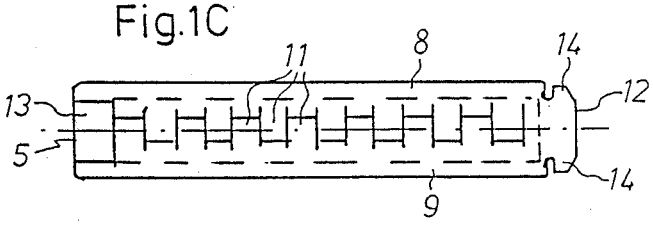
Figure 1D:
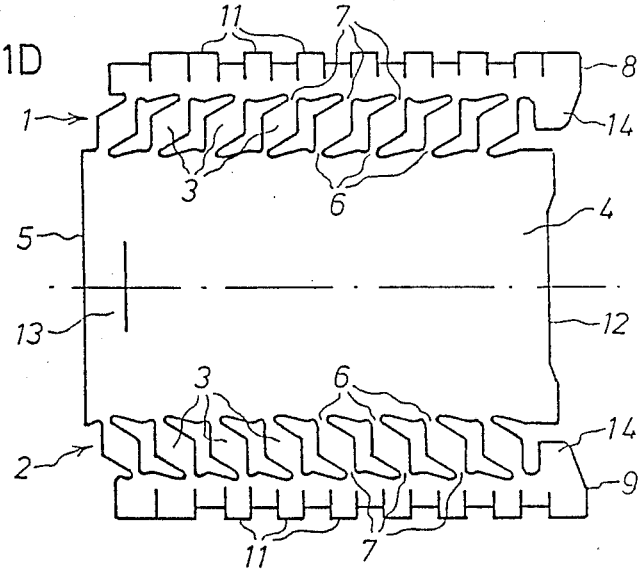

A first design of the device is shown in FIGS. 1A–1D and is formed from an originally flat strip of, for example sheet metal. By a punching process, the sheet metal is furnished with two parallel rows 1 and 2 of inclined, pressure absorbing braces 3 with a generally rhombic shape. The sheet metal between the rows of braces 1 and 2 forms the connecting member 4, to which the ends 6 of the braces 3, which are staggered towards the insertion end of the device 5, are flexibly joined. The other ends 7 of the braces 3 are connected by two axial gripping bars 8,9 formed in the sheet metal, to which these ends 7 of the braces 3 are flexibly joined. The connecting member, as best shown in FIG. 1B, is formed into a cylindrical sleeve 10, upon each side of which the rows of braces 1 and 2 are bent up. The two gripping bars 8 and 9 are provided with teeth or fingers 11, which are pressed into a plaited engagement with each other, as shown in FIG. 1C. The teeth 11 are suitably formed with raised and lowered edges in such an order that an increased frictional engagement with the side walls of the fixing hole may be achieved.

The gripping surfaces, which in order to fix the device are to engage the sides of the hole, are in this arrangement formed by the external surfaces of the gripping bars 8,9 and the external surface of the connecting member 4.

The sleeve 10 is preferably threaded internally, adjacent to the outer end 12 of the device. It can also be provided with a stop at the inner end for a tension bar furnished with a bulge or head.

The transverse dimensions of the device are such that a certain initial pressure against the sides of the hole is achieved by the insertion of the device into the hole. If an axial pull out force is applied to the connecting member, after insertion into the hole, then the pulling out of the device from the hole is prevented intitially by the frictional drag of the gripping surfaces of the device which through the insertion of the device have been brought into engagement with the sides of the hole. If the pull out force on the connecting member 4 is increased, this will result in a minor slipping movement of the connecting member 4 and the sleeve 10, which in turn causes an increased inclination of the braces 3 in relation to the axis of the device. The braces are resistant to buckling yet relatively flexibly jointed at their ends 6,7. Due to the inclination of the braces 3, the gripping surfaces will thus be forced apart from each other in a transverse direction. The expansion pressure against the sides of the hole will thereby increase, which in turn will increase the total frictional drag of the gripping surfaces, so that further pulling out of the device is prevented and a self-locking effect is achieved.

The sleeve 10 is provided with a stop 13, as shown in FIG. 1A, in order to prevent the tipping over of the braces 3 when the device is fixed in holes which are too big.

To achieve an increased load bearing capacity of the braces 3, these can be stamped with longitudinal stiffening grooves. The brace joints 6,7 are suitably dimensioned so that the bending resistance is not too great in relation to the desired pulling out load capacity and fixing dimension. Further, the number of braces should be as large as possible, so that the pressure against the sides of the hole is distributed evenly over as large an area as possible.

It is also to be preferred that the joints at the brace ends 6,7 are so formed that they display a certain springing action during changes of inclination of the braces 3, which can be advantageous where the hole is of uneven configuration. When drilling in hard materials, the shape of the hole often becomes conical to a certain degree. The rigid, but at the same time sprung, device in accordance with the invention can then compensate for such a hole form by having braces of differing lengths or by the device itself being conical in shape.

To facilitate the loosening and extraction of the device, after it has been fixed in a hole, the gripping bars 8,9 are each provided with a hook 14 at the outer end of the device. To loosen the device, an axial pulling out load is applied to these hooks 14, whereupon the inclination of the braces 3 is reduced and the gripping surfaces, i.e. the gripping bars 8,9 and the connecting member 4, are drawn towards each other in a direction away from the sides of the holes.

In order to fulfil the above-mentioned requirements concerning the compensation of errors in drilling, the sleeve 10 in the arrangement shown has been formed so that it is eccentrically placed in relation to the centre of a circle circumscribing the device. In order to compensate for a wrongly sited hole, the device is rotated about its own axel so that the centre of the sleeve 10 is positioned at the required point.

Figure 2:
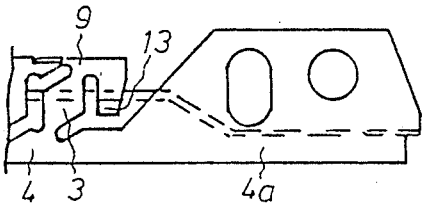
FIG. 2 shows a suspension attachment related to the device in FIG. 1.

A particular advantage of the design described above is that the connecting member can be provided with an extension or shank **4*a*, as shown in FIG. 2, so that various components or accessories may be affixed to diversify the uses of the device. The rigid and hollow sleeve 10 also enables fixings to be made to a separate bar or wire projecting out from the sleeve 10 with its inner end fastened inside it. During such applications, the device is wedged initially in the hole by forcing the gripping bars 8,9** axially into the hole with a hammer or the like.

Of special importance is the device's pull out resistance. To maximize this the gripping surfaces which engage the sides of the hole should be stamped or cut with a grip pattern or the like. Since the device in accordance with the invention can, to advantage, be manufactured from hard sheet steel, then a strong, permanent grip may be achieved upon hard and rough materials. The pull out resistance is, in addition, affected by the angle of the braces 3 relative to the direction of pull upon loading. This angle is ultimately dependent upon the diameter of the hole as well as the the dimensions of device at the outset. Another factor bearing on performance are the device's material properties and proportions, as well as the total length.

Figure 3A:
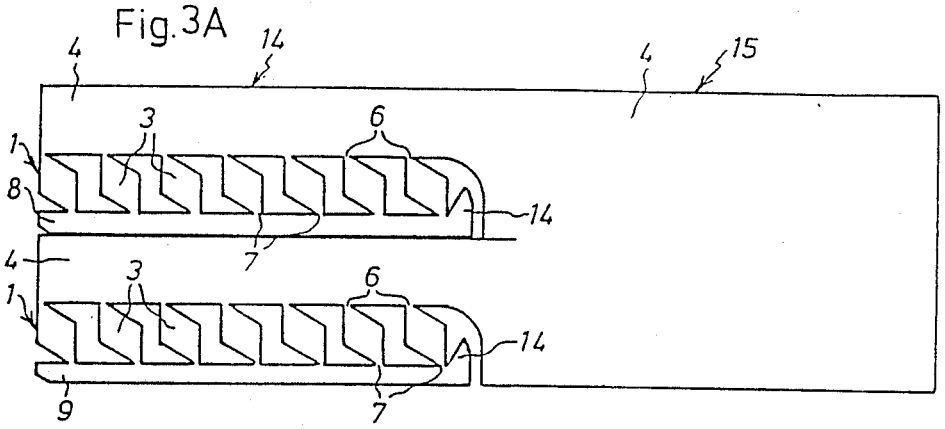
FIGS. 3A–3C show another design of the device in accordance with the invention.
Figure 3B:
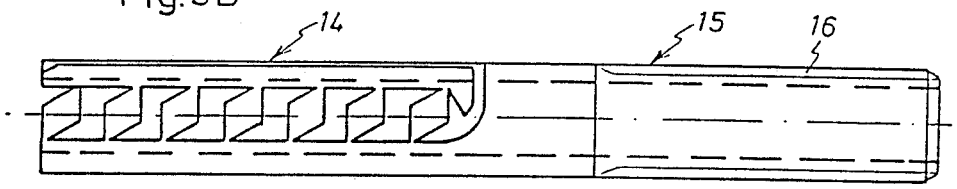
Figure 3C:
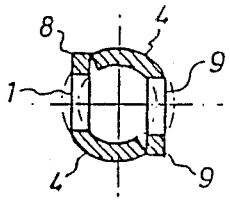
Figure 3D:
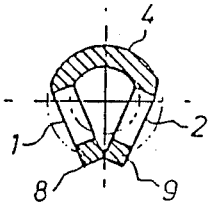
FIG. 3D shows a variant of the design shown in FIGS. 3A–3C.

Another design of the device in accordance with the invention for anchoring purposes can be manufactured directly from a tube. The purpose of such an arrangement, of which an example can be seen in FIGS. 3A–3D, is to limit the external dimensions so that the gripping members can be accommodated within the same width as the shaft and an external thread, where required. The modification can have a metal strip, the width of which is equivalent to the circumference of the intended shaft diameter. At one end, the anchor part 14, some material is removed to form the two rows 1,2 of inclined braces 3. The braces 3 are arranged in two parallel rows with the gripping bars 8,9 so positioned that the braces are approximately diametrically opposite each other (FIG. 3C). The outer part of the device 15 is cylindrical and furnished with an internal or external thread 16. FIG. 3D shows an alternative orientation of the rows of braces 1,2 and the gripping bars 8,9.

FIGS. 4A–4D show a design of the invention specially suitable for reinforcing or strengthening rock strata or the like. A plate or metal strip has, by punching or pressing, been furnished with the two rows 1,2 of inclined, buckle-resistant and pressure absorbing braces 3. The ends 6 of the braces 3, which are inclined towards the insertion end of the device 5, are flexibly joined to the central connecting member 4, and the other ends 7 of the braces are joined by gripping bars 8,9.

Figure 4A:
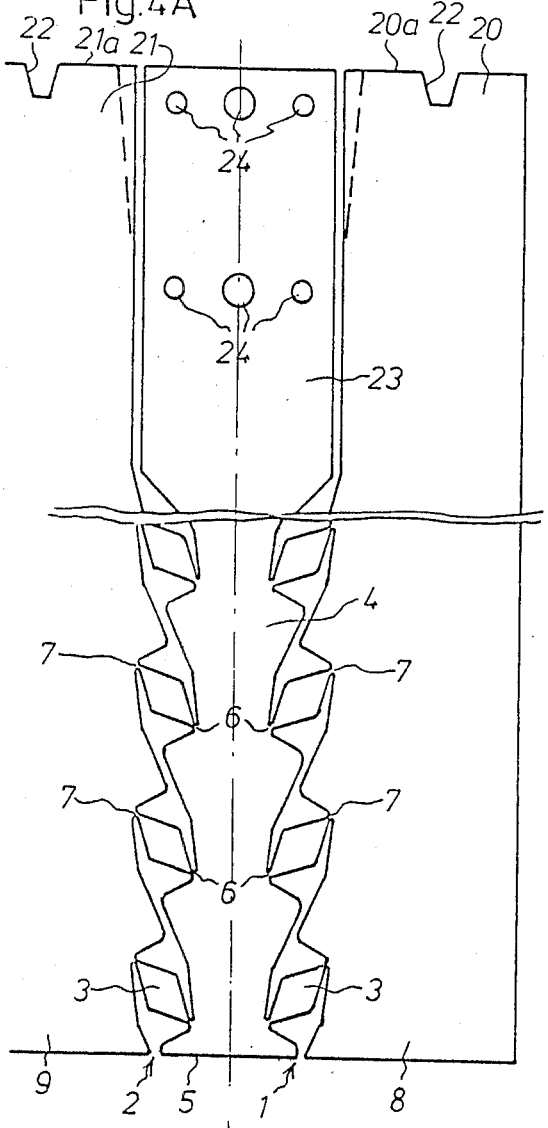
FIGS. 4A–4D show a third design of the device in accordance with the invention for reinforcing purposes.
Figure 4B:
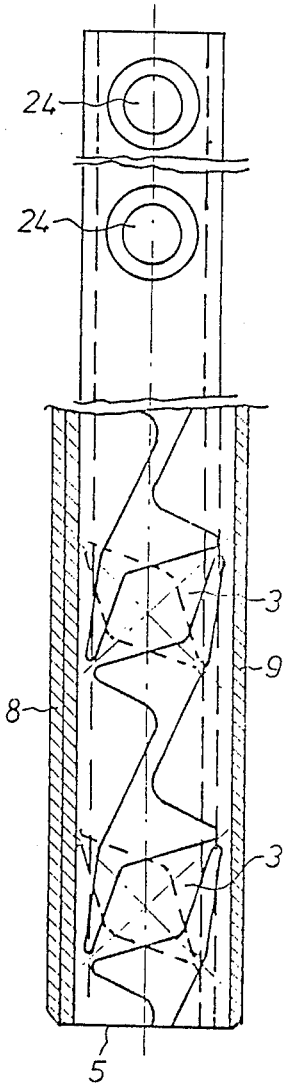
Figure 4D:
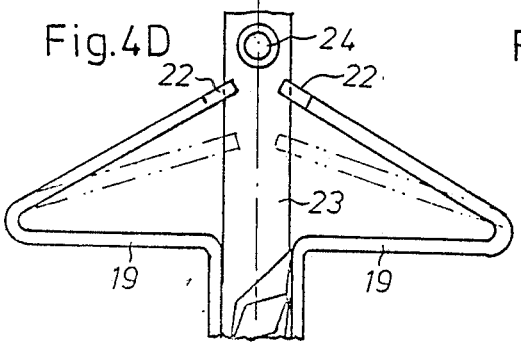
Figure 4C:
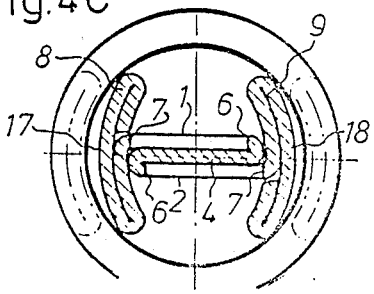

The sheet metal has been bent into the form shown in FIGS. 4B and 4C, whereupon the rows of braces 1,2 have been further bent to each side of the connecting member 4, directly opposite each other. The radially projecting gripping bars 8,9 are so bent or curved that they form two diametrically opposed gripping surfaces 17,18 whose radius of curvature to some degree coincide with the radius of the mounting hole.

To fix the reinforcing device, as in FIGS. 4A–4D, into a hole, it is inserted in the contracted condition shown in FIG. 4C into the hole, after which, by mechanical or hydraulic means, the connecting member 4 is pulled out axially in relation to the gripping surfaces 17, 18 which are turned towards the sides of the hole. The braces 3 will thereby raise themselves, so that the brace ends 7 in row 1 move radially away from the brace ends 7 in the other row 2, which results in the gripping surfaces 17,18 being pressed against the sides of the hole with great force.

The braces 3 are of a suitable width, length, number and separation, and with an inclination relative to the centre line, so that the required expansion force upon the gripping surfaces 17,18 can be achieved along the entire length of the reinforcement device. The tool required for activation and expansion should be able to be preset for varying pulling forces related to the length and number of braces of the reinforcing device being used. The length of the device may, with advantage, be arranged to allow jointing.

At its outer end the metal is formed into a locking mechanism, the construction and function of which may be more closely observed in FIG. 4D. The locking mechanism is formed of two locking arms 20, 21, which are extensions of the gripping bars 8,9 and project outside the hole. At the end edges **20*a*, 21*a* of these arms are two notches 22. Once the device is anchored in the hole, the axial position of the connecting member 4 in relation to the gripping bars 8,9 can be fixed by the gripping bars 20,21 being bent out radially in order to form an end plate which rests against the material 19. These are then bent diagonally inwards against an extension 23 of the connecting member 4, so that the notches 22 engage each side of the extension 23. The locking arms 20, 21 are then pressed towards the hole until they reach the position shown by the dotted lines in FIG. 4D. To achieve a good locking effect, it is preferable for the extension piece 23** to be grooved. The fixation of the reinforcing device should be carried out automatically once the tightening tool has brought the device to its preset expansion and force.

For the suspension of pipes, cables, safety nets etc., the outer extension piece 23 of the connecting member 4 can be provided with fixing holes 24 or the like.

Figure 5:
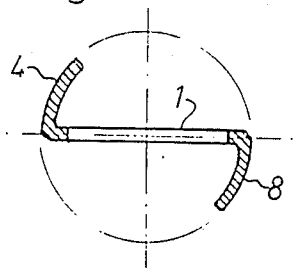
FIG. 5 shows a fourth design of the device in accordance with the invention.

FIG. 5 shows a cross section of a further design of the invention in which form the device has only one row 1 of pressure absorbing braces 3 and only one gripping bar 8, the connecting member 4, the row of braces 1 and the gripping bar 8 having been bent into a Z-form with the outside surfaces of the connecting member 4 and the gripping bar 8 formed in accordance with the radius of the hole.

Figure 6B:
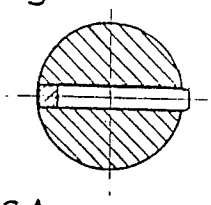
FIGS. 6A–6C show simple variants in accordance with the invention with free brace ends.
Figure 6A:
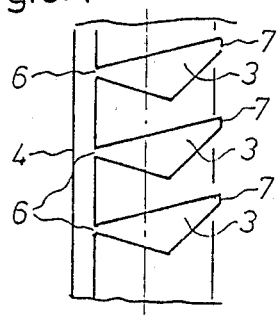
Figure 6C:
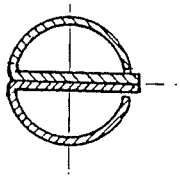

In its simplest form, the row of braces 3 is not provided with a pressure-distributing gripping bar 8. In such a design, of which an example is shown in FIG. 6A, it is the free ends 7 of the braces 3 which form gripping points which press against and engage the sides of the hole. Other designs of the device with free brace ends 7 without gripping bars are shown in FIGS. 6B and 6C.

Figure 7C:
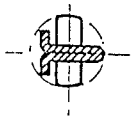
FIGS. 7A–7C show a fifth design of the device in accordance with the invention.
Figure 7A:
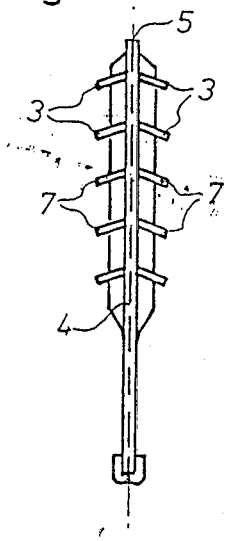
Figure 7B:
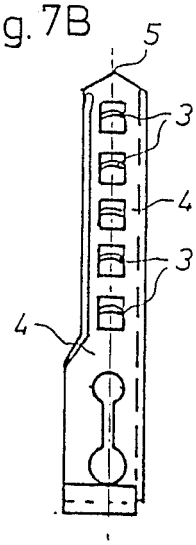

In the device shown in FIGS. 7A–7C, two rows of braces as in FIG. 6A are so connected that the inner ends 6 of the braces 3 are turned towards each other. As in the previous designs, the design shown in FIGS. 7A–7C is made from one piece of sheet metal, but here the braces 3 are so formed and bent out from the rest of the body that they are flexible about lines which coincide with the surface of the body , whereas in the variants described above the braces 3 are flexible about lines which are at right angles to the surface of the body or piece of sheet metal.

Figure 8:
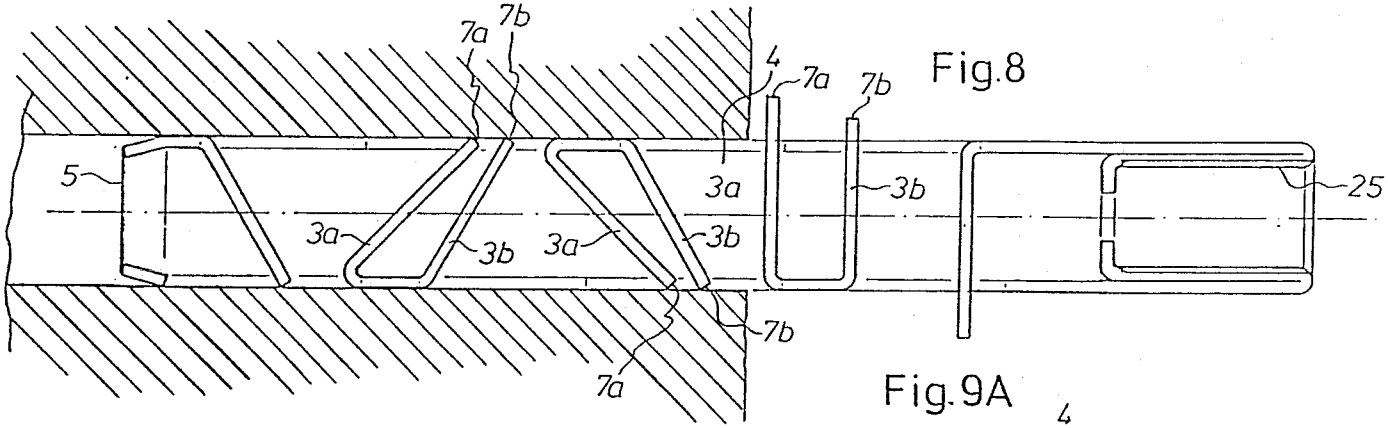
FIG. 8 shows a sixth design of the device in accordance with the invention.

FIG. 8 shows a design of the device in which the braces are so positioned that they extend through the centre of the hole from one side of the device to the other, when this has been inserted. In this design, the device is made from a single piece of sheet metal, which on either side of the connecting member has been cut to allow the freeing of tongue-formed braces in each row. The braces 3 have then been bent up and in over the connecting member 4, as shown in the figure, whereby the braces are arranged in pairs along the length of the device. The braces in each such pair are inclined in the same direction relative to the axis of the device, and the braces in each alternate pair are inclined in the opposite direction. FIG. 8 shows the device partly inserted into a hole, where the braces which have not yet engaged the sides of the hole are at right angles to the direction of insertion. As seen in the figure, the first brace, the one towards the insertion end of the device 3*a*, in each pair is longer than the second brace 3*b* in the same pair. Upon insertion of such a pair of braces, the first brace 3*a* will be slanted with an inclination closer to the axis of the device than the second brace 3*b*. The free ends 7*a*, 7*b* of the braces will at the same time be brought to a position immediately adjacent to each other. Since the second brace 3*b* in each pair has a more transverse attitude, it is this brace 3*b* which will take up the main part of the compressive force from the sides of the holes when a pull out load is applied to the connecting member 4. The first, inner brace 3*a* will merely "follow" without any significant expansive locking function. Where the pull out load is sufficiently large, the outer brace 3*b* may be brought into such a transverse position that it comes into contact with the free end 7*a* of the inner brace 3*a*.

This design has the advantage that a satisfactory locking function is achieved even where the diameter of the hole varies along its length. If the hole should have a larger diameter in one section then the inner brace 3*a*, upon the application of a pull out load, will take over the locking function. The connecting member is, furthermore, provided with an internal thread 25 at its outer end.

Figure 9A:
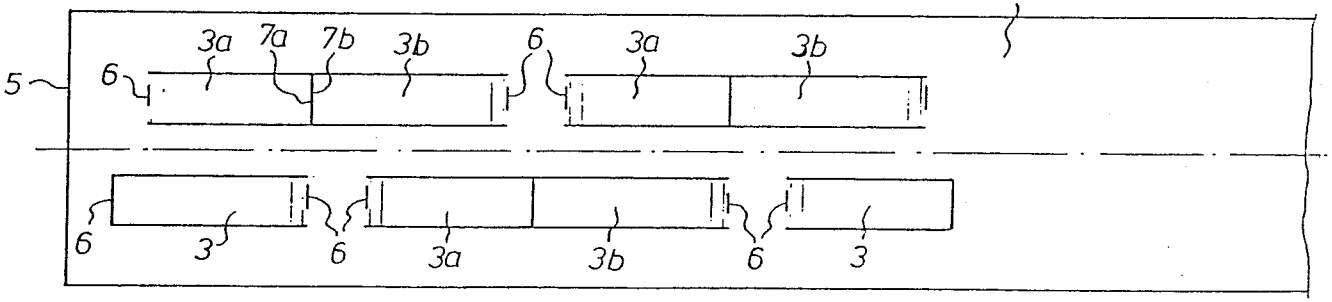
FIGS. 9A and 9B show the original flat strip and a cross section respectively, of a seventh design of the invention which exploits the principle shown in FIG. 8.
Figure 9B:
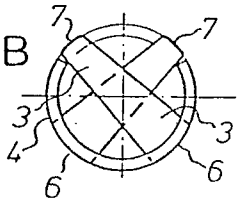

FIGS. 9A and 9B show another design of the device where the "servo-locking function", as described in FIG. 8, with braces arranged in pairs is used. FIG. 9A shows the metal strip with the cuts therein which, after bending, form the construction shown in axial direction in FIG. 9B. As FIG. 9A shows, the two rows of braces 1,2 are staggered, so that the braces 3 in one row 1 do not come into contact with those in the other row 2 once the strip has been bent into the desired form. Seen along the axis of the device, the braces form a cross with the braces 3 at 90° to each other. The connecting member 4 is then formed after the inside of the hole. Great stability is achieved with this design since the device acquires, upon insertion and anchoring in the hole, four evenly spaced rows of gripping surfaces or points around its circumference.

It should be noted that the designs shown in FIGS. 8 and 9A–B have a special advantage in that there is no material wastage during the freeing of the braces.

I claim:

1. Device for anchoring in/or reinforcing hard materials, such as stone, concrete and the like, which device consists of:

a continuous elongated body made from a one-piece metal strip extending along an axis and adapted to be axially inserted at an insertion end of the body into a mounting hole in said materials, said body having gripping surfaces which are expansible transverse to said axis of the body and arranged, when expanded, to bear upon and engage sides of the hole for anchoring the body in the hole, said body, for achieving said expansion, further having pressure absorbing braces disposed between the gripping surfaces and flexibly joined, at a first end of each brace, to the body so as to permit said expansion which is adapted to be achieved by applying an axial pull-out load to the body, wherein said braces are arranged in one or more axially oriented rows in the body, said braces, at least when the body is in its inserted position in the hole, being so inclined to the axis of the body that said first end of each brace is axially offset towards the insertion end of the body in relation to a second end of said each brace, said body further comprising an axially elongated connecting member flexibly joined with each of the braces at the first end thereof and which has an axial length which is at least the same as the axial length of said rows, said first ends of the braces of each row being connected to the connecting member at joints at axially distrtibuted locations along the connecting member, and wherein said axial pull-out load is to be applied to said connecting member in order to produce compressive forces in the braces in a direction coinciding with a line through the first and second ends of each brace and to produce an increased inclination of the braces with respect to said axis of the body, thereby producing an expansion force on the gripping surfaces in a direction towards the sides of the hole.

2. Device in accordance with claim 1, wherein the distance across the axis of the body between the expansible gripping surfaces is so matched to the cross section of the hole, that the inclination of the braces, as a direct result of the device's insertion into the hole, is somewhat reduced, and the joints between the first ends of the braces and the connecting member are flexible and springy, so that reduction of inclination caused by the insertion of the device produces springing forces in the joints, and thereby, via the braces, a pressing out of the gripping surfaces against the sides of the hole.

3. Device according to claim 1, wherein the connecting member which links the braces together forms at least one first gripping surfaces of the expansible gripping surfaces, the at least one first gripping surfaces are so arranged as to act together, for the anchoring of the device, with other gripping surfaces of the expansible gripping surfaces at the second ends of the braces.

4. Device according to claim 1, wherein the second ends of the braces are free and form the gripping surfaces sited at the second ends of the braces.

5. Device according to claim 1, wherein the braces included in the same row are arranged in pairs, the braces forming such a pair being, at least when the device is inserted in the hole, slanted in the same direction in relation to the axis of the body, the first brace, nearest the insertion end of the device, of a pair displaying a smaller inclination from the axis of the body than the second brace of the pair, and the two free ends of a pair of braces being so situated with relation to one another that an increase in inclination of the second brace in a pair, caused by a sufficiently large pull out load upon the connecting member, will first bring the free end of the fist brace into contact with the second brace and thereafter result in an increase in inclination of the first brace, the free end of which will thereby be brought into engagement with the side of the hole.

6. Device according to claim 1, wherein the body includes at least one gripping bar, separated from the connecting member by the braces, with which the second ends of the braces are flexibly joined for the transfer of compressive forces in the braces via the braces' second ends to the sides of the hole, the at least one gripping bar serving to guide the braces in each row and make possible loosening and extraction of the device by application of a pull out load axially upon the at least one gripping bar for an axial displacement of the at least one gripping bar in relation to the connecting member.

7. Device according to claim 1, wherein the one-piece metal strip of the body comprises two similar axial rows of braces punched out or freed in some other way on each side of the connecting member, the metal strip having two similar gripping bars, with which the second ends of the braces in each row are joined, the connecting member being bent 180° along two axial lines, which are immediately adjacent to the first brace ends in each row of braces, the rows of braces lying flat against each side of the connecting member and opposite each other, and the gripping bars being bent along axial lines to a form which coincides with the form of the sides of the hole, whereby the device may be anchored in the hole by the application of pressure in the direction of hole's interior upon the gripping bars during the application of an axial pull out load to the connecting member.

8. Device according to claim 1, wherein the sheet metal at the outer end of the device is formed into a locking mechanism for the fixing of the axial position of the connecting member in relation to the gripping bars, after the anchoring of the device in the hole.

9. Device according to claim 1, wherein the connecting member, in addition to forming the first gripping surfaces, also form an axially continuous sleeve along the interior of the device which will accept and hold a screw means.

10. Device according to claim 1, wherein the axial center line of the sleeve is eccentric in relation to the axial center line of the device.

* * * * *

UNITED STATES PATENT AND TRADEMARK OFFICE

CERTIFICATE OF CORRECTION

PATENT NO. : 4,826,358

DATED : May 2, 1989

INVENTOR(S) : Bertil BURSTRÖM

It is certified that error appears in the above-identified patent and that said Letters Patent is hereby corrected as shown below: On the title page;

[76] Inventor: Bertil Burström, Boarp 790, 26200 Ängelholm, Sweden

[19] "Brustrom" should read --Burstrom--

Signed and Sealed this

Third Day of July, 1990

*Attest:*

*Attesting Officer*

HARRY F. MANBECK, JR.

*Commissioner of Patents and Trademarks*